United States Patent [19]

Ohtsuka et al.

[11] Patent Number: 4,935,306

[45] Date of Patent: Jun. 19, 1990

[54] THERMAL IMPRINT INK SHEET

[75] Inventors: Keita Ohtsuka, Isehara; Hiroshi Sasao, Kawasaki; Hiroo Ueda, Atsugi, all of Japan

[73] Assignee: Fujitsu Limited, Kawasaki, Japan

[21] Appl. No.: 413,755

[22] Filed: Sep. 28, 1989

[30] Foreign Application Priority Data

Oct. 11, 1988 [JP] Japan ..... 63-255516

[51] Int. Cl.[5] ..... B41M 5/20

[52] U.S. Cl. ..... 428/480; 428/195; 428/483; 428/484; 428/488.1; 428/913; 428/914

[58] Field of Search ..... 428/195, 207, 480, 484, 428/483, 488.1, 913, 914

[56] References Cited

FOREIGN PATENT DOCUMENTS 293887 12/1986 Japan ..... 428/913

*Primary Examiner*—Pamela R. Schwartz

*Attorney, Agent, or Firm*—Staas & Halsey

[57] ABSTRACT

An ink sheet including an ink layer composed of 10 weight part of urethane wax, 1 weight part of ester wax, 5 weight part of paraffin wax, 5 weight part of dyestuff and 2 weight part of carbon black, on a polyester resin film substrate through an adhesive layer composed of 15 weight part of a (vinyl chloride)-(vinyl acetate) copolymerized resin, 15 weight part of carbon black and 48 weight part of polyester mixture composed of two kinds of polyester resin one of which has a glass transition temperature of 67° C. and the other of which has a glass transition temperature of −20° C., mixed in a weight ratio of 75/25.

10 Claims, 3 Drawing Sheets

| Tg | -20°C | 4°C | 25°C | 45°C | 67°C |
|---|---|---|---|---|---|
| BLOCKING | × | × | ×~△ | △~○ | ○ |
| 5th(OD)/1st(OD) 25°C | 60% | 60% | 60% | 60% | 60% |
| 5th(OD)/1st(OD) 5°C | 60% | 55% | 30% | 25% | 20% |

FIG. 4

| Tg=-20°C Tg=67°C | 100/0 | 75/25 | 50/50 | 25/75 | 15/85 | 0/100 |
|---|---|---|---|---|---|---|
| BLOCKING | × | △ | △~○ | ○ | ○ | ○ |
| 5th(OD)/1st(OD) 25°C | 60% | 60% | 60% | 60% | 60% | 60% |
| 5th(OD)/1st(OD) 5°C | 60% | 55% | 50% | 50% | 40% | 20% |

FIG. 5

| Tg=4°C Tg=67°C | 100/0 | 75/25 | 50/50 | 35/65 | 25/75 | 0/100 |
|---|---|---|---|---|---|---|
| BLOCKING | × | ×~△ | △~○ | ○ | ○ | ○ |
| 5th(OD)/1st(OD) 25°C | 60% | 60% | 60% | 60% | 60% | 60% |
| 5th(OD)/1st(OD) 5°C | 55% | 55% | 50% | 50% | 40% | 20% |

FIG. 7

THERMAL IMPRINT INK SHEET

BACKGROUND OF THE INVENTION

The present invention relates to a thermal imprint ink sheet repeatedly used in a thermal imprinting apparatus. The thermal ink sheet consists of an ink layer, a substrate and an anchor coated adhesive layer inserted between the ink layer and the substrate, and the present invention, in particular, relates to the anchor coated adhesive layer.

The thermal imprint ink sheet, which will be simply called "ink sheet" hereinafter, is used in a thermal imprinting apparatus for thermally imprinting data such as characters or graphics on a recording paper. The thermal imprinting is performed by inserting the ink sheet between the recording paper and a thermal head of the thermally imprinting apparatus, applying an electrical signal of the data to the thermal head. That is, when the ink sheet is heated by the thermal head in accordance with the electrical signal, an ink material is oozed from the ink layer and imprinted on the recording paper.

Before, the ink sheet was consisted of a substrate and an ink layer and used only once and thrown away after imprinting. However, since an anchor coated adhesive layer is applied to the ink sheet and the ink layer is improved, the ink sheet comes to be used repeatedly with economy.

FIG. 1 is a partially cross-sectional view of an ink sheet 4 which can be repeatedly used. As shown in FIG. 1, the ink sheet 4 includes a substrate 1 made of polyester resin, an thermally imprinting ink layer 3 and an anchor coated adhesive layer 2 inserted between the ink layer 3 and the substrate 1; wherein, an thermally imprinting ink layer and an anchor coated adhesive layer will be called simply an "ink layer" and an "adhesive layer" respectively hereinafter. As shown in FIG. 1, since the ink sheet 4 is inserted between a recording paper 6 and a thermal head 5 of a thermally imprinting apparatus, the substrate 1 and the recording paper 6 touch a thermal head 5 and the ink layer 6 respectively. Accordingly, when the thermal head 5 is heated up higher than 300° C. in accordance with the electrical signal, the ink layer 3 is heated up higher than 100° C. As a result, an ink material in the ink layer 3 is oozed out and imprinted on the recording paper 6. However, the ink layer 3 is kept staying in the ink sheet with the substrate 1 even though the ink layer 3 is heated up to 100° C. by virtue of adhesiveness of the adhesive layer 2.

A Japanese Laid Open Patent No. SHO 57-105382 discloses about the adhesive layer. According to SHO 57-105382, the adhesive layer (of the prior art) is made of a fine powder consisting of resin and an inorganic material. Japanese Laid Open Patent SHO 59-166572 discloses about the ink layer. According to SHO 59-166572, the ink layer is made of an ink material having a low melting point, consisting of fatty acid amide, dyestuff and a filler material made of carbon black, and the ink layer is coated on a surface of the adhesive layer by using an organic solvent and dried up.

As mentioned above, the adhesive layer 2 is an indispensable element for the ink sheet to be repeatedly used. That is, in reference to FIG. 1, since the adhesive layer 2 is applied to the ink sheet 4, the ink layer 3 can be made adhere to the substrate 1 without peeling off from the substrate 1 even though the temperature of the ink sheet 4 is raised and lowered repeatedly in the imprinting. Every time the ink layer 3 is heated, the ink material impregnated in the filler of carbon black is oozed out and imprinted on the recording paper 6.

Since the thermal imprinting apparatus is allowed to operate at a room temperature from 10° C. to 35° C. in consideration of an environmental temperature, in winter and summer, around the apparatus, the adhesive layer 2 is required to have good flexibility and adhesiveness at the room temperature. To satisfy the requirement, there, is described in a Japanese Laid Open Patent SHO 60-49998 a mixed material of polyamide resin and polyester resin applied to the adhesive layer, so that the ink layer tightly adheres to the substrate. Wherein, the polyamide resin and the polyester resin in the adhesive layer well adhere to the fatty acid amide in the ink layer and the polyester resin in the substrate respectively.

However, the prior art ink sheet has problem such that: when the environmental temperature around the ink sheet decreases below the room temperature, the flexibility of the ink sheet is deteriorated, going so far as the ink layer happens to be peeled off from the substrate. Furthermore, if the above deterioration of the flexibility is improved by applying another material appropriate to the low environmental temperature to the ink sheet, the ink sheet produces a problem called "blocking", which will be explained later, in a fabricating process of the ink sheet.

As well known, a material being in a state of glass presents a phenomenon called "glass transition", and a temperature of the material presenting the glass transition is called a "glass transition temperature" which will be simply called a "Tg" hereinafter. In a case of the present invention, a Tg of the polyester resin in the adhesive layer is important. That is, if the temperature of the adhesive layer decreases below a Tg of the polyester resin in the adhesive layer, the adhesive layer becomes hard like glass and begins to loose its flexibility. On the contrary, if the temperature of the adhesive layer exceeds the Tg, the adhesive layer becomes soft and begins to be melted like paste as the temperature increases more. Therefore, when the adhesive layer includes a material having a Tg sufficiently low to maintain the flexibility at a low temperature, the adhesive layer becomes sticky at a high environmental temperature. This causes to occur the problem of blocking in a fabricating process of the ink sheet.

The ink sheet 4 in FIG. 1 is fabricated in accordance with two steps as follows, by using the same processing facilities 100 as shown in FIGS. 2(*a*) and 2(*b*):

(1) the substrate 1 is fabricated, which is not shown in FIGS. 2(a) and 2(*b*), and rolled to a first roll 8A shown in FIG. 2(*a*), then, using the processing facilities 100 as shown in FIG. 2(*a*), the substrate 1 is drawn out from the first roll 8A and led to a coating machine 7 in which the adhesive layer 2 is coated on a surface of the substrate 1 by using an organic solvent and dried up at a temperature of approximate 50° C. to 60° C., and the substrate 1 having the adhesive layer 2 coated thereon, which will be called an intermediate sheet 4' hereinafter, output from the coating machine 7 is rolled to a second roll 8B which is stocked for a while; and (2) using the same processing facilities 100 as shown in FIG. 2(*b*), the intermediate sheet 4' produced in step 1) is drawn out from the second roll 8B and led to the coating machine 7 in which, in this time, the ink layer 3 is coated by using another organic solvent and dried at a temperature of approximate 50° C. to 60° C., producing the ink sheet 4 which is rolled to a third roll 8C.

In the above step (2), if the adhesive layer 2 of the intermediate sheet is sufficient sticky in the second roll 8B, the adhesive layer 2 will stick to a rear side, on which no adhesive layer is coated, of the substrate 1 of an inner side intermediate sheet 4' rolled in the second roll 8B. This problem is called "blocking" and occurs due to a low Tg of the polyester resin in the adhesive layer, compared with the environmental temperature, in which the coating the machine 7 is located.

To avoid the blocking problem occurring in step (2), it can be considered that the process of coating the ink layer 3 in the coating machine 7 in step (2), is performed immediately after the adhesive layer 2 is coated in the coating machine 7 in step (1), without stocking the intermediate sheet 4' in the second roll 8B. However, if the ink sheet is fabricated in such continuous process, two coating rooms 7 must be arranged in the processing facilities 100 and two layers (the adhesive layer 2 and the ink layer (3) must be coated at the same running speed. The coating machine 7 is very expensive and the two layers, which have a different composition and thickness and use different solvent individually, must be fabricated at the same running speed. Therefore, when the initial costs for the processing facilities and the complicated arrangement of fabrication conditions are considered, it must be concluded that the continuous process is not advisable.

The polyester resin in the adhesive layer is effective for adhering the adhesive layer to the substrate because the adhesiveness between the polyester resin in the adhesive layer and a polyester film of the substrate is excellent. Further, the polyester resin in the adhesive layer has a feature that the polyester resin is easily soluted by the solvent and has good compatibility with other resin materials in the adhesive layer. The other resin materials are for the adhesiveness to the ink layer. Thus, the polyester resin in the adhesive layer is very effective for obtaining excellent adhesiveness, flexibility and manufacturabilty.

However, in the prior art, only one kind of polyester resin is used in the adhesive layer. Therefore, the ink sheet of the prior art has a problem that if the polyester resin used in the adhesive layer has a low Tg, the blocking problem easily occurs, and if the polyester resin has a high Tg, the ink layer tends to be easily peeled off from the substrate when the ink sheet is used in a low environmental temperature, so that it becomes hard to use the ink sheet repeatedly.

SUMMARY OF THE INVENTION

An object of the present invention is to obtain an ink sheet which can be used repeatedly in wide range of environmental temperature.

Another object of the present invention is to solve the problem of blocking which occur in the intermediate step of the fabrication process of the ink sheet.

Still another object of the present invention is to improve flexibility of the ink sheet.

These objects can be achieved by fabricating the ink sheet having an ink layer on a polyester resin substrate film through an adhesive layer composed of 48 weight part of the polyester mixture of two kinds of polyester resins, 15 weight part of (vinyl chloride)-(vinyl acetate) copolymerized resin and 15 weight part of carbon black. One polyester resin of the mixture has the glass transition temperature ($T_g$) higher than the highest temperature of environmental temperature in fabrication and operation and the other polyester resin of the mixture has the $T_g$ lower than the lowest temperature of environmental temperature in fabrication and operation. The environmental temperature means the environmental temperature in the fabrication process of the ink sheet and the environmental temperature in the operation of the ink sheet, hereinafter. When one kind of the polyester resin with $T_g$, for instance 67° C., higher than the highest temperature of environmental temperature is used as a main component of the adhesive layer, the blocking behavior is hardly or not observed in the intermediate step of the fabrication process of the ink sheet. However, poor flexibility is observed at environmental temperature of 5° C. for the ink sheet which is fabricated by providing an ink layer, which is composed of 10 weight part of urethane wax, 1 weight part of ester wax, 5 weight part of paraffin wax, 5 weight part of dyestuff and 2 weight part of carbon black, on the adhesive layer including the polyester resin. When one kind of the polyester resin with $T_g$, for instance −20° C., lower than the lowest temperature of environmental temperature is used as a main component of the adhesive layer, the blocking behavior is observed in the intermediate step of the fabrication process of the ink sheet, however good flexibility is observed at environmental temperature of 5° C. for the ink sheet which is fabricated by providing an ink layer on the adhesive layer including the polyester resin. The blocking behavior in the intermediate step of the fabrication process is estimated whether the polyester resin film having the adhesive layer can be easily drawn out from the roll manually or not after the first process of the fabrication. The flexibility of the ink sheet which is fabricated by providing an ink layer on the adhesive layer including the polyester resin is estimated from the difference between the ratio of optical density (OD) of the thermally imprinted character at the fifth time (5th(OD)) to optical density of the thermally imprinted character at the first time (1st(OD) ) in ambient temperature of 5° C. and the similar ratio in ambient temperature of 25° C., when the same place of the ink sheet is thermally imprinted repeatedly by the recording energy of 35 mJ/mm$^2$.

When the mixture of the polyester resin with $T_g$ of −20° C. and the polyester resin with $T_g$ of 67° C. in the ratio of 25:75 is used as the main component of the adhesive layer, the problem of blocking is not caused and the flexibility of the ink sheet which is fabricated by providing an ink layer on the adhesive layer including the mixture of polyester resins is so satisfactory that the difference between 5th (OD)/1st (OD) at 25° C. and 5th (OD)/1st (OD) at 5° C. is 10%. Since the flexibility of the ink sheet is good even at low temperature such as 5° C., the ink layer is not peeled from the polyester film substrate during operation.

Also in the case which the polyester resin with $T_g$ of 4° C. and the polyester resin with $T_g$ of 67° C. in the ratio of 35:65 is used as the main component of the adhesive layer, the problem of the blocking is not caused and the flexibility of the ink sheet which is fabricated by providing an ink layer on the adhesive layer including the mixture of polyester resin is so satisfactory that the difference between 5th (OD)/1st (OD) at 25° C. and 5th (OD)/1st (OD) at 5° C. is 10%.

It is the glass transition temperature $T_g$ of the polyester resin that is important for the present invention. Accordingly, a polyester resin having $T_g$ can be replaced by another polyester resin having the same $T_g$, even though other properties of the polyester are different.

BRIEF DESCRIPTION OF THE DRAWINGS

FIG. 2 (*b*) is a schematic drawing illustrating the second step of manufacturing an ink sheet;

FIG. 4 is a table showing the results of experiments on the blocking of a polyester resin film substrate having an adhesive layer including one kind of polyester resin and on the flexibility of an ink sheet fabricated by providing an ink layer on the adhesive layer, for five kinds of polyester resins for the adhesive layer each having different $T_g$;

FIG. 5 is a table showing the results of experiments on the blocking of a polyester resin film substrate having an adhesive layer including a mixture of two kinds of polyester resins and on the flexibility of an ink sheet fabricated by providing an ink layer on the adhesive layer, for several kind of the mixture having the different mixing ratio of polyester resins;

FIG. 7 is a table showing the results of experiments on the blocking of a polyester resin film substrate having an adhesive layer which includes a mixture of two kinds of polyester resins having different $T_g$ from that of in FIG. 5 and on the flexibility of an ink sheet fabricated by providing an ink layer on the adhesive layer, for several kind of the mixture having the different mixing ratio of polyester resins.

DESCRIPTION OF THE PREFERRED EMBODIMENTS

The adhesive layer in the ink sheet embodying the present invention will be described in the following three embodiments in reference to FIGS. 1 to 7.

The First Embodiment

Figure 1:
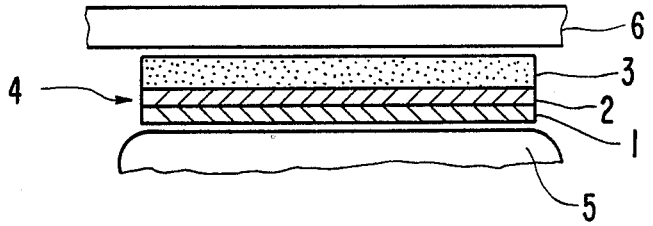
PRIOR ART FIG. 1
FIG. 1 is a schematic cross-sectional view of a conventional ink sheet illustrating a way of thermal imprinting.
Figure 2A:
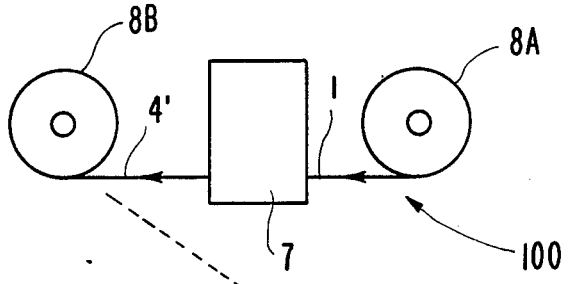
FIG. 2 (*a*) is a schematic drawing illustrating the first step of manufacturing an ink sheet.
Figure 2B:
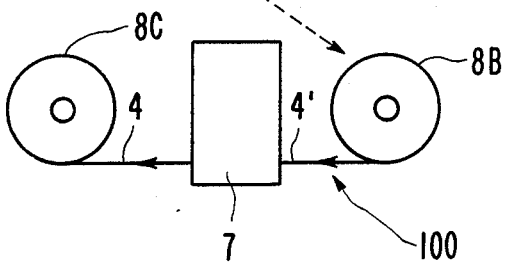
Figure 3:
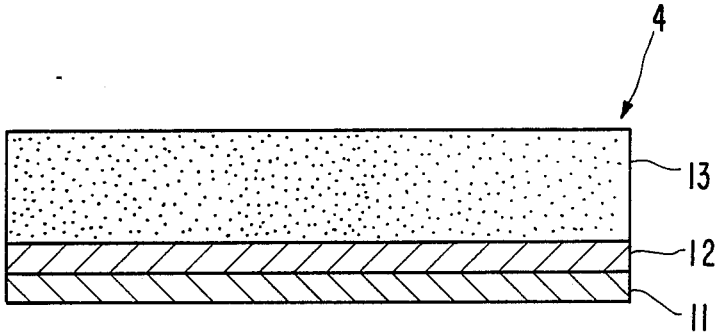
FIG. 3 is a schematic cross-sectional view of an ink sheet fabricated by the present invention.

FIG. 3 shows a cross-sectional view of an ink sheet 14 of the present invention schematically. In the ink sheet 14, an ink layer 13 is formed on a substrate of polyester resin film 11 through an adhesive layer 12, as seen in FIG. 2. The best characteristics of the ink sheet is obtained for the composition of the ink sheet 14, as described below.

First, the composition of the adhesive layer 12 is 48 weight part of a polyester mixture, 15 weight part of (vinyl chloride)-(vinyl acetate) copolymerized resin and 15 weight part of carbon black. The mixture of the polyester, which has the property of adhering to the polyester of the substrate 11, is produced from two kinds of polyester resin having different glass transition temperature, $T_g$. One is the polyester resin with $T_g$ of −20° C., manufactured by HITACHI KASEI POLYMER Co. as AC-63, and the other is the polyester resin with $T_g$ of 67° C., manufactured by TOYOBO Co. as Vylon 200. The former is expressed as "polyester resin($T_g$=−20° C.)", and the latter is expressed as "polyester resin($T_g$=−67° C.)" hereinafter. The ratio of the weight percentage of two kinds of polyester resin in the mixture of the adhesive layer 2 is as follows: polyester resin($T_g$=−20°0 C.); polyester resin($T_g$=67° C.) =25:75. The (vinyl chloride)-(vinyl acetate) copolymerized resin, manufactured by NIPPON KAYAKU Co., has the property adhering to urethane wax which is, the main component of the ink layer 13. The carbon black powder, which is also manufactured by NIPPON KAYAKU Co. as Kayaset Black 149K mixture compound covered with the copolymerized resin for dispersing carbon black powder to the solvent, is an antistatic agent preventing the adhesive layer 12 from charging. The materials of the adhesive layer 12 described above are dissolved in an organic solvent of toluene and methyl-ethyl ketone in the ratio of 2:8 (in volume). This is coated on a roll type polyester resin film of 210 mm in width drawn out from a roll 8A in FIG. 2 (*a*) using a coating machine 7.,This the adhesive layer of 6 μm in thickness is formed. After drying the coated adhesive layer 12, the film is rolled to a roll 8B in FIG. 2 (*a*) with the diameter of one inch by a torque of 1 Kg·cm. The thickness of the adhesive layer becomes 1 μm after drying. The film, which is the polyester resin film 1 having the adhesive layer 12 on it, is kept at environmental temperature of 25° C. for seven days.

Second, an ink layer 13 is formed on the adhesive layer 12 of the film drawn out the roll 8B. The ink layer 13 is composed of 10 weight part of urethane wax, manufactured by NIPPON OIL and FATS Co. as Alflow DH-20, 1 weight part of ester wax, manufactured by MITSUBISHI KASEI Co. as Daiacarna PA-30L, 5 weight part of paraffin wax, manufactured by NIPPON SEIRO Co. as HNP-10, 5 weight part of dyestuff, manufactured by NIPPON KAYAKU Co. as Kayaset Black KR and 2 weight part of carbon black, manufactured by NIPPON KAYAKU Co. This carbon black in the ink layer 13 acts as filler material instead of antistatic agent in the adhesive layer 12. This materials of the ink layer 13 described above are dissolved in an organic solvent containing ketone such as acetone. Then, the solution is coated on the surface of the adhesive layer 12 by the coating machine 7 and rolled to a roll 8C after drying. As a result, an ink layer 13 of 7 μm in thickness is formed on the adhesive layer 12.

This ink sheet 14 fabricated by the way described above can be repeatedly usable. That is, a following test called "repeatability test" is carried out. The same place of the ink sheet 14 is thermally imprinted with a recording energy of 35 mJ/mm$^2$ repeatedly in ambient temperature of 5° C. and 25° C., respectively. Setting optical density (OD) of the thermally imprinted at the first time is 1.0 (OD), the ratio of the optical density of that at the fifth time to the optical density at the first time is measured. This ratio is expressed by 5th (OD) / 1st (OD) at 5° C. The result of measurements is that 5th (OD) / 1st (OD) at 5° C. is 50% and 5th (OD) / 1st (OD) at 25° C. is 60%. Namely, 5th (OD) at 25° C. is 0.6 (OD) and 5th (OD) at 5° C. is 0.5 (OD), accordingly the difference between 5th (OD) at 25° C. and 5th (OD) at 5° C. is 0.1 (OD). For the character pattern of 24×24 dot composed of stroke with stroke width of 0.3 mm in thermal imprint recording, the difference of 0.1 (OD) of optical density is the minimum distinguishable difference in the range of 0.5 (OD) to 1.0 (OD). Therefore, 0.1(OD) of the difference between 5th (OD) at 25° C. and 5th (OD) at 5° C. is allowable.

The result described above is the best one, which is not accidentally obtained but is obtained from a lot of preliminary experiments. In order to make clear the present invention regarding improvement of the adhesive layer, detailed experiments on the adhesive layer which has one kind of polyester resin will be described. First, five kinds of materials for the adhesive layer 12 are provided as described above. The composition of the materials is as follows; 48 weight part of polyester resin($T_g$), 15 weight part of (vinyl chloride)-(vinyl acetate) copolymerized resin, manufactured by NIPPON KAYAKU Co. and 15 weight part of carbon black, manufactured by NIPPON KAYAKU Co. $T_g$ is −20° C., 4° C., 25° C., 45° C. and 67° C., respectively. The polyester resin ($T_g$=−20° C.) is manufactured as AC-63,and the polyester resins ($T_g$=25° C.) and ($T_g$=45° C.) are manufactured as prototype by HITACHI KASEI POLYMER Co.. The polyester resins ($T_g$=4° C.) and ($T_g$=67° C.) are manufactured by TOYOBO Co. as Vylon 300 and Vylon 200, respectively. These materials are dissolved in an organic solvent of toluene and methyl-ethyl ketone in the ratio of 2:8 (in volume). Using the solution, the adhesive layer of 1 μm in thickness in dried state is formed on the polyester resin film 11 which is 210 mm in width and 6 μm in thickness. In this step of fabrication process, the blocking behavior is tested for the five kinds of the adhesive layer 12. After drying the coated adhesive layer, the film is rolled to the roll 8B with the diameter of one inch by a torque of 1 Kg·cm. The film, which is the polyester resin film 11 having the adhesive layer 12 on it, is kept at environmental temperature of 25° C. for seven days. Further, the ink layer 3 is formed on the adhesive layer 12 in the same way as described above. The test of repeatability is performed with recording energy of 35 mJ/mm$^2$ in ambient temperature of 25° C. and 5° C., respectively.

The result of the experiments is shown in FIG. 4 in a form of table. In the table, the blocking behavior in the step after adhesive layer 12 is provided on the polyester resin film 11 and the flexibility of the ink sheet are indicated for the five kinds of polyester resin used in the adhesive layer 12. In the table, the temperature in the first row is $T_g$'s of the five kinds of polyester resins. The blocking behavior in the second row is expressed by a white circle, a white triangle and a multiplying mark. The white circle means that the polyester resin film 11 having the adhesive layer 12 can be easily drawn out from the roll manually. The white triangle means that the blocking is slightly observed when the polyester resin film 11 having the adhesive layer 12 is drawn out from the roll manually. The multiplying mark means that the polyester resin film 11 having the adhesive layer 12 can not be drawn out manually due to the blocking. The percentage written in the third and the fourth row represents 5th (OD)/1st (OD) at 25° C. and 5th (OD)/1st (OD) at 5° C., respectively. As seen from the table, the difference between 5th (OD)/1st (OD) at 25° C. and 5th (OD) / 1st (OD) at 5° C. for the polyester resin($T_g$=4° C.) and the polyester resin($T_g$=−20° C.) is 5% and 0%, respectively. This means that the adhesive layer composed of polyester resin having lower $T_g$ than ambient temperature show good flexibility even at low temperature as 5° C. On the contrary, the blocking occurs seriously causing damage in the intermediate step of fabrication process. On the other hand, as seen from the table the difference between 5th (OD)/1st (OD) at 25° C. and 5th (OD)/1st (OD) at 5° C. for the polyester resin($T_g$=45° C.) and the polyester resin($T_g$=67° C.) is 35% and 40%, respectively. This means that the adhesive layer composed of polyester resin having higher $T_g$ than ambient temperature show poor flexibility at 5° C. On the contrary, the blocking is not significant. Particularly, the polyester resin film 11 having the adhesive layer 12 composed of the polyester resin($T_g$=67° C.) can be easily drawn out from the roll manually. The case where polyester resin($T_g$=25° C.) is used in the adhesive layer 12 is shown in the middle column of the table. The blocking behavior is observed in the intermediate step of the fabrication process. The flexibility of the ink sheet at the temperature of 5° C. is poor, since the difference between 5th (OD)/1st (OD) at 25° C. and 5th (OD)/1st (OD) at 5° C. is 30%, as seen from the table. From the experimental result shown in the table of FIG. 4, it is understood that so far as the one kind of polyester resin is used for the adhesive layer 12, one condition which there is no problems of the blocking in the intermediate step of the fabrication process and another condition which the ink sheet fabricated by providing the ink layer 13 on the adhesive layer 12 shows desirable flexibility at low temperature such as 5° C. are not satisfied simultaneously.

For the reason described above, use of a mixture of two kinds of polyester resin, in which one has $T_g$ higher than 25° C. and the other has $T_g$ lower than 25° C., as a component of the adhesive layer 12 is tried. The polyester resin($T_g$=−20), manufactured by HITACHI KASEI POLYMER Co., has best flexibility at 5° C. as seen from FIG. 4. On the other hand, the polyester resin($T_g$=67° C.), manufactured by TOYOBO Co. does not show blocking property. These two polyester resin are mixed with different mixing ratios in weight, 75/25, 50/50, 25/75, and 15/85 and used as a component of the adhesive layer 12. After testing of blocking behavior the ink sheet 14 fabricated by providing the ink layer 13 on the adhesive layer 12. Then, the flexibility of the ink sheet 14 is measured in the same way described in FIG. 4. The result of the measurement is shown in the table of FIG. 5. In the table, the second column corresponding to the polyester resin ( $T_g$=−20) is identical with the second column in the table of FIG. 4. The seventh column corresponding to the polyester($T_g$=67° C.) is identical with the sixth column in the table of FIG. 4. In the table of FIG. 5, the mixing ratio of the polyester resin ($T_g$=−20° C.) to the polyester resin($T_g$=67° C.) is written in the first row. The mixtures of the polyester resin, whose mixing ratios in weight are 50/50, 25/75 and 15/85 respectively, can be used as a component of the adhesive layer 12 causing little blocking. Moreover, the ink sheet 14 fabricated by providing the ink layer 13 on the adhesive layer 12 shows desirable flexibility at low temperature such as 5° C., because the difference between 5th (OD)/1st (OD) at 25° C. and 5th (OD)/1st (OD) at 5° C. is less than 20%. The mixture of the polyester resin whose mixing ratio is 25/75 is the example described in the beginning of the first embodiment and exhibit the best result.

Figure 6:
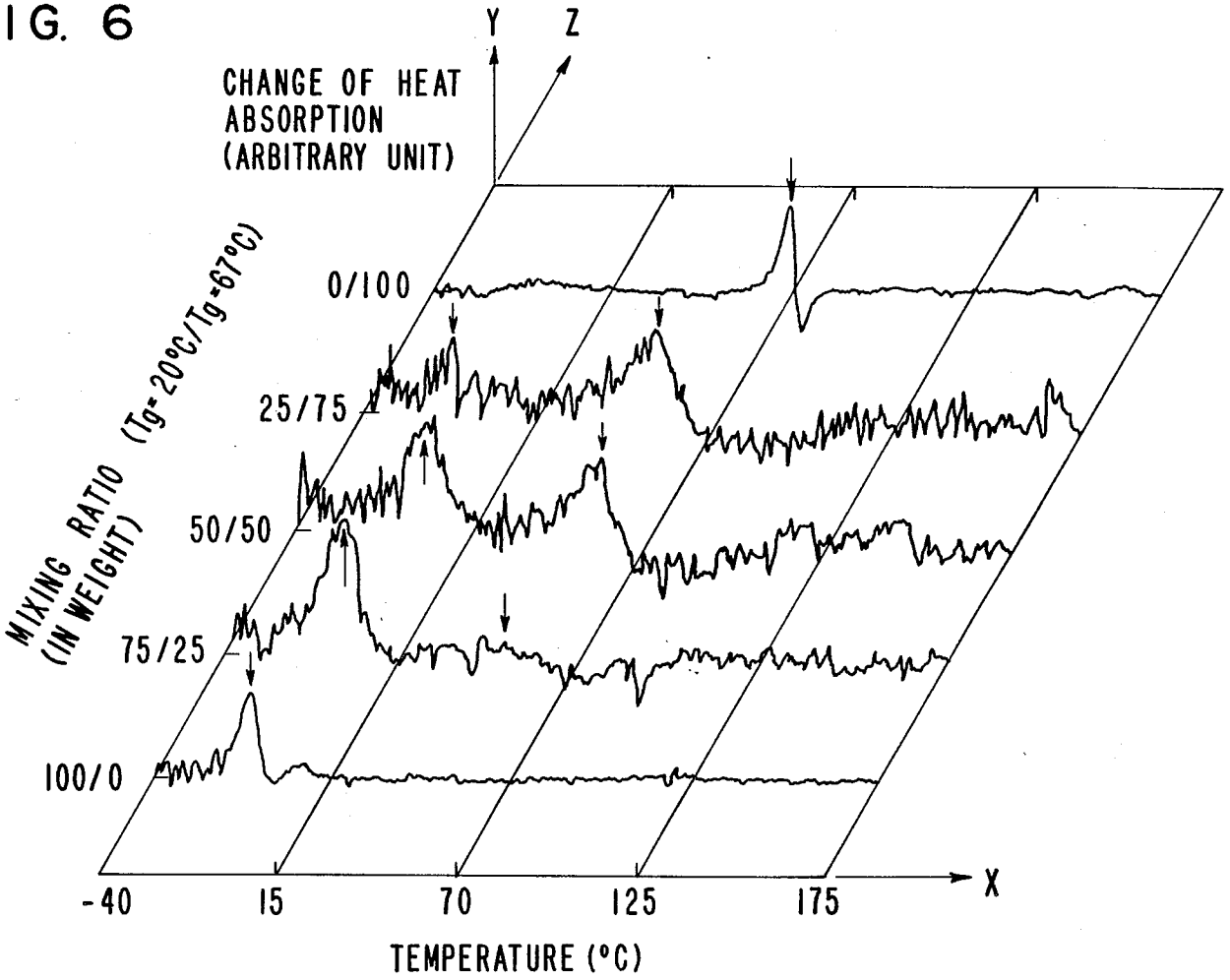
FIG. 6 is a graph showing the relation between change of heat absorption in the mixture of polyester resin and scanning temperature plotted for the mixing ratio of the mixture as parameter.

To confirm the purpose to confirm effects mixing of two kinds of polyester resins, change of heat absorption in polyester resin is measured for several kinds of mixtures in FIG. 5 using a differential scanning calorimetry. FIG. 6 shows a schematic drawing in three dimensional display of graphs obtained by the differential scanning calorimetry illustrating variation of $T_g$ with the mixing ratio. In FIG. 6, the direction of x, y and z represent scanning temperature, change of heat absorption in the polyester mixture and mixing ratio of the polyester mixture, respectively. The peak points of curves showing the change of heat absorption in the polyester mixture, which is indicated by an arrow, represent $T_g$'s. The curve showing the change of heat absorption in the polyester mixture is simply called "the curve", hereinafter. The peak point of the curve corresponding to the mixing ratio of 0/100 lies at 67° C. which shows the $T_g$ of the polyester resin ($T_g$=67° C.). The peak point of the curve corresponding to the mixing ratio of 100/0 lies at −20° C. which shows the $T_g$ of the polyester resin ($T_g$=−20° C.). It can be seen that there are two peaks due to the polyester resin ($T_g$=67° C.) and the polyseter resin ($T_g$=−20° C.) for the three curves corresponding the the mixing ratio of 25/75, 50/50 and 75/25. Further, in the curve corresponding to the mixing ratio 25/75, it should be noted that the peak due to the polyester resin ($T_g$=−20° C.) is large, though the mixing ratio is small and the peak due to the polyester ($T_g$=67° C.) is shifted by small amount to lower temperature. When a small amount of the polyester resin ($T_g$=−20° C.) is mixed with the polyester resin ($T_g$=67° C.), the former acts as a plasticizer so that flexibility of the mixture is improved, being aided by the fact that the peak due to the polyester resin ($T_g$=67° C.) is shifted by small amount to a lower temperature. Blocking is not caused because enough of the polyester resin ($T_g$=67° C.) remains in the polyester mixture with the mixing ratio of 25/75. For the curves corresponding to the mixing ratios 50/50 and 75/25, the peak corresponding to the polyester resin ($T_g$=67° C.) is decreased, resulting in the blocking.

The Second Embodiment

A combination of two kinds of polyester resins as a main component of the adhesive layer 12, which has different pair of $T_g$ from the first embodiment is examined. The composition of the adhesive layer 12 is 48 weight part of a polyester mixture, 15 weight part of (vinyl chloride)-(vinyl acetate) copolymerized resin and 15 weight part of carbon black. The mixture of the polyester is produced from two kinds of polyester resin having different glass transition temperature, $T_g$. One is the polyester resin($T_g$=4° C.), manufactured by TOYOBO Co., and the other is the polyester resin($T_g$=67° C.), manufactured by TOYOBO Co. These two polyester resin are mixed with different mixing ratios in weight, 75/25, 50/50, 35/65, and 25/75. The (vinyl chloride)-(vinyl acetate) copolymerized resin and the carbon black are manufactured by NIPPON KAYAKU Co.. These materials of the adhesive layer 12 are dissolved in an organic solvent of toluene and methyl-ethyl ketone in the ratio of 2:8 (in volume). In the same way as described in the first embodiment, this is coated on a roll type polyester resin film of 210 mm in width using the coating. Thus the adhesive layer of 6 μm in thickness is formed. After drying the coated adhesive layer 12, the film is rolled to a roll with the diameter of one inch by a torque of 1 Kg·cm. The thickness of the adhesive layer becomes 1 μm after drying. The film, which is the polyester resin film 1 having the adhesive layer 12 on it, is kept at room temperature (25° C.) for seven days. In this step of the fabrication process the blocking behavior is tested. Next, the same ink layer 13 as that described in the first embodiment is formed on the adhesive layer 12. The same "repeatability test" as described in the first embodiment is.performed for the ink sheet 14 having the six different kind of the polyester mixture as the main component in the adhesive layer 12. The result of the measurement is summarized in the table of FIG. 7. The first column corresponds to the polyester resin ($T_g$=4° C.), which is identical with the second column of the table in FIG. 4. The seventh column corresponds to the polyester resin($T_g$=67° C.), which is identical with the sixth column of the table in FIG. 4. As seen from the table, the mixture of two kinds of polyester resin with the mixing ratios of 50/50, 35/65 and 25/75 show little problem of the blocking. Moreover, the flexibility of the ink sheet 14 corresponding to these three mixture of polyester resin is desirable because the difference between 5th(OD)/1st(OD) at 25° C. and at 5° C. is smaller than 20%. Particularly, what is corresponds to 35/65 does not show the blocking and show so desirable flexibility that the difference between 5th(OD)/1st(OD) at 25° C. and at 5° C. is 10%.

In the second embodiment, it is, confirmed that the blocking problem associated with the fabrication process and the flexibility at low temperature can be resolved when one polyester resin having a low $T_g$as 4° C. and another polyester resin having a high $T_g$ as 67° C. are mixed in a definite mixing ratio and are used as the main component of the adhesive layer 12. In the first and second embodiments the mixing of the polyester resin($T_g$=−20° C.) and the polyester resin($T_g$=67° C.) and the mixing of the polyester resin($T_g$=4° C.) and the polyester resin($T_g$=67° C.) are disclosed. However, the mixing of the polyester resin having $T_g$ lower than 10° C. and the polyester having $T_g$ higher than 35° C. has a large effect on obtaining satisfactory result for the blocking and flexibility. Since the glass transition temperature $T_g$ of the polyester resin is important for the present invention, a polyester resin having $T_g$ can be replaced by another polyester having the same $T_g$, even though other properties of the polyester are different.

The materials composing the adhesive layer 12, such as (vinyl chloride)-(vinyl acetate) copolymerized resin can be replaced by another material in accordance with the wax included in the thermal imprint layer 13.

The Third Embodiment

The composition of the ink layer 13 can be varied as follows:

10 weight part of urethane wax, 0 to 5 weight pat of ester wax, 2 to 10 weight part of paraffin wax, 2 to 10 weight part of dyestuff and 0 to 4 weight part of carbon black.

However, one of the preferable composition is, except that described in the first and second embodiments:

10 weight part of urethane wax, 1 weight part of ester wax, 5 weight part of paraffin wax, 2 weight part of dyestuff and 5 weight part of carbon black.

When the mixture of the polyester resin($T_g$=−20° C.) and the polyester resin($T_g$=67° C.) is used as the main component of the adhesive layer 12 and the ink layer 13 having the composition of 10 weight part of urethane wax, 1 weight part of ester wax, 5 weight part of paraffin wax, 2 weight part of dyestuff and 5 weight part of carbon black is used for an ink layer 13, the same result as shown in the table of FIG. 5 is obtained.

Further, when the mixture of the polyester resin ($T_g$=4° C.) and the polyester resin ($T_g$=67° C.) is used as the main component of the adhesive layer 12 and the ink layer 13 having the composition of 10 weight part of urethane wax, 1 weight part of ester wax, 5 weight part of paraffin wax, 2 weight part of dyestuff and 5 weight part of carbon black is used for an ink sheet, the same result as shown in the table of FIG. 7 is obtained.

As described in the first embodiment, the (vinyl chloride)-(vinyl acetate) copolymerized resin is used as a component of the adhesive layer 12 for good adhesive property to the urethane wax which is main component of the ink layer 13. So, the kind of resin composed of the adhesive layer 12 is selected so as to be adhesive to the wax included in the ink layer 13. The combinations of a polyester resin in the adhesive layer 12 and a wax in the ink layer 13 are as follows. That is, the urethane wax, the fatty acid amid, ester wax and paraffin wax in the ink layer 13 are selected respectively, in accordance with the (vinyl chloride)-(vinyl acetate) copolymerized resin, polyamid resin, ethylene-(vinyl acetate) resin and ethylene-(vinyl acetate) copolymerized resin in the adhesive layer 12.

The mixture of two kinds of polyester resin which is a main component of the adhesive layer 12, is selected so that the polyester resin which is a component of the mixture has good adhesive property to the polyester resin substrate film 11. However, the other resins of the substrate, which have nearly the same solubility parameter(SP) as SP(=10.6) of the polyester resin which is a component of the mixture, can be used as the resin of substrate film. These resins are as follows; (The numerals in the parenthesis is the value of SP.) polystyrene resin (9.1), polyethylmethacrylate resin (9.2), polymethylmethacrylate resin (9.2 to 9.4), polyvinylidenechloride resin (9.3), polyvinyl acetate resin (9.4), polyvinyl chloride resin (9.6), polyethylacrylate resin (9.7), polyurethane resin (10.0), polymethylacrylate resin (10.2) and polymethacrylonitrile resin (10.6).

What is claimed is:

1. An ink sheet used for thermally imprinting a character or graphic with a thermal head on recording medium, in a thermally imprinting apparatus, said ink sheet comprising:

a film substrate comprising resin;

an adhesive layer formed on said film substrate, comprising a mixture of a first polyester resin and a second polyester resin, said first polyester resin having a first glass transition temperature higher than the environmental temperature at which the ink sheet is used or fabricated and said second polyester resin having a second glass transition temperature lower than said environmental temperature at which the ink sheet is used or fabricated; and an ink layer comprising resin and a dye formed on said adhesive layer.

2. An ink sheet according to claim 1, wherein said first glass transition temperature is 67° C. and said second glass transition temperature is −20° C.

3. An ink sheet according to claim 2, wherein said mixture is defined so that a mixing ratio of said first to second polyester resin in weight is between 50/50 and 85/15.

4. An ink sheet according to claim 1, wherein said first glass transition temperature is 67° C. and said second glass transition temperature is 4° C.

5. An ink sheet according to claim 4, wherein said mixture is defined so that a mixing ratio of said first to second polyester resin is between 50/50 and 75/25.

6. An ink sheet according to claim 1, wherein said adhesive layer further comprises (vinyl chloride)-(vinyl acetate) copolymerized resin and carbon black, and weight parts of said mixture of said first and second polyester resin, (vinyl chloride)-(vinyl acetate) copolymerized resin and carbon black in said adhesive layer are 48, 15 and 15 respectively.

7. An ink sheet according to claim 1, wherein said ink layer comprises 10 weight part of urethane wax, 0 to 5 weight part of ester wax, 2 to 5 weight part of paraffin wax, 2 to 10 weight part of dyestuff and 0 to 5 weight part of carbon black.

8. An ink sheet according to claim 1, wherein said ink layer comprises a kind of wax selected from the group of ester wax and paraffin wax, and said adhesive layer further comprises ethylene-(vinyl acetate) copolymerized resin.

9. An ink sheet according to claim 1, wherein said film substrate comprises polyester resin.

10. An ink sheet according to claim 1, wherein said film substrate comprises resin selected from the group consisting of polystyrene resin, polyethylmethacrylate resin, polymethylmethacrylate resin, polyvinylidenechloride resin, polyvinyl acetate resin, polyvinyl chloride resin polyethylacrylate resin, polyurethane resin, polymethylacrylate resin and polymethacrylonitrile resin.

* * * * *